US007553263B2

(12) United States Patent
Webb et al.

(10) Patent No.: US 7,553,263 B2
(45) Date of Patent: Jun. 30, 2009

(54) CALF EXTENSION WEIGHT TRAINING MACHINE

(75) Inventors: Gregory M. Webb, Independence, VA (US); Benjamin Ball, Independence, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 626 days.

(21) Appl. No.: 11/069,655

(22) Filed: Mar. 1, 2005

(65) Prior Publication Data

US 2006/0199707 A1 Sep. 7, 2006

(51) Int. Cl.
*A63B 21/062* (2006.01)

(52) U.S. Cl. ..... 482/100; 482/97; 482/137

(58) Field of Classification Search ..... 482/100, 482/137, 97, 51–52, 130, 142, 92–94
See application file for complete search history.

(56) References Cited

U.S. PATENT DOCUMENTS 1,671,096 A * 5/1928 Anderson ..... 482/79
4,813,666 A * 3/1989 Costilow et al. ..... 482/80
4,883,270 A * 11/1989 Maag ..... 482/97
5,762,590 A 6/1998 St. Fleur
6,074,328 A * 6/2000 Johnson ..... 482/97
6,296,596 B1 * 10/2001 Alessandri et al. ..... 482/100
6,394,938 B1 5/2002 Tornabene

* cited by examiner

*Primary Examiner*—Jerome Donnelly
(74) *Attorney, Agent, or Firm*—Myers Bigel Sibley & Sajovec

(57) ABSTRACT

An exercise machine for exercising the calf muscles of a seated exerciser includes: a frame configured to rest on an underlying surface; a seat assembly mounted on the frame on which the exerciser sits; a movement arm pivotally interconnected with the frame forwardly of the seat assembly; a heel pad mounted on the frame forwardly of the seat assembly and configured to receive the heel of the exerciser; a trailing link pivotally attached to the movement arm; a foot engagement member attached to the trailing link such that the foot engagement member is positioned above and forwardly of the heel pad, the foot engagement member having an engagement surface configured to receive a portion of the sole of the foot of the exerciser; and a resistance-imparting unit interconnected with the movement arm. The movement arm is movable by the exerciser between a flexed position, in which the sole of the foot of the exerciser engages the engagement surface of the foot engagement member as the heel of the exerciser engages the heel pad, such that the foot is generally perpendicular to the shin of exerciser, and an extended position, in which the foot points away from the shin as the sole of the foot of the exerciser remains engaged with the engagement surface of the foot engagement member and the heel remains engaged with the heel pad.

36 Claims, 4 Drawing Sheets

CALF EXTENSION WEIGHT TRAINING MACHINE

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement is the calf extension, in which the exerciser's foot moves from a flexed position in which it is generally perpendicular to the shin to an extended position in which the toes point away from the shin. This exercise can be performed with the exerciser in a standing position, in which case the resistance is often applied to the exerciser's shoulders via a harness or the like. Alternatively, the exercise can be performed in a sitting position, which is preferred by many exercisers because they are not required to balance while exercising and there is no vertical force exerted directly on the spinal column. Some seated calf exercise machines are designed so that the exerciser's legs are bent and resistance is applied on the upper surfaces of the thighs (in which case the resistance is applied to and lifted by the thighs as the toes point). Other seated calf machines are designed so that the exerciser has his legs relatively straight, and the resistance is applied at the ball of the foot (in which case the resistance is forced away from the shin as the toes point). Generally speaking, the calf extension movement exercises the gastrocnemius, plantaris and soleus muscles of the lower leg.

In some instances exercisers prefer to use a "straight-leg" seated calf machine, as such a design provides greater extension and stretch to the calf muscles in the flexed position. A typical "straight-leg" seated calf machine (exemplified by the 2ST Seated Calf machine, available from Nautlilus HPS, Inc., Independence, Va.) has a movement arm that is pivotally interconnected to a stationary frame and a platform that is fixed to the movement arm that the feet contact. Extension of the feet causes the platform to pivot relative to the frame. One of the potential shortcomings of such machines is a tendency for the exerciser to be lifted "up" (i.e., the heel is lifted off of the foot platform) when performing the exercise. Also, the movement arm is typically not designed to accommodate exercisers with different sizes of feet. As such, it may be desirable to provide a seated calf exercise machine that can address these issues.

SUMMARY OF THE INVENTION

The present invention is directed to a seated calf exercise machine that can address some of the shortcomings of prior machines. As a first aspect, embodiments of the present invention are directed to an exercise machine for exercising the calf muscles of a seated exerciser, comprising: a frame configured to rest on an underlying surface; a seat assembly mounted on the frame on which the exerciser sits; a movement arm pivotally interconnected with the frame forwardly of the seat assembly; a trailing link pivotally attached to the movement arm; a foot engagement member attached to the trailing link, the foot engagement member having an engagement surface configured to receive a portion of the sole of the foot of the exerciser; and a resistance-imparting unit interconnected with the movement arm. The movement arm is movable by the exerciser between a flexed position, in which the sole of the foot of the exerciser engages the engagement surface of the foot engagement member such that the foot is generally perpendicular to the shin of exerciser, and an extended position, in which the foot points away from the shin as the sole of the foot of the exerciser remains engaged with the engagement surface of the foot engagement member. The resistance-imparting unit provides resistance to the movement of the movement arm from the flexed position to the extended position.

As a second aspect, embodiments of the present invention are directed to an exercise machine for exercising the calf muscles of a seated exerciser, comprising: a frame configured to rest on an underlying surface; a seat assembly mounted on the frame on which the exerciser sits; a movement arm pivotally interconnected with the frame forwardly of the seat assembly at a first pivot; a foot engagement member connected with the movement arm, the foot engagement member having an engagement surface configured to receive a portion of the sole of the foot of the exerciser; and a resistance-imparting unit as described above. The movement arm is movable by the exerciser between a flexed position, in which the sole of the foot of the exerciser engages the engagement surface of the foot engagement member such that the foot is generally perpendicular to the shin of exerciser and the engagement surface is a first distance from the first pivot, and an extended position, in which the foot points away from the shin as the sole of the foot of the exerciser remains engaged with the engagement surface, the engagement surface being positioned a second distance from the first pivot that is greater than the first distance.

As a third aspect, embodiments of the present invention are directed to an exercise machine for exercising the calf muscles of a seated exerciser, comprising: a frame configured to rest on an underlying surface; a seat assembly mounted on the frame on which the exerciser sits; a movement arm pivotally interconnected with the frame forwardly of the seat assembly; a foot engagement member connected with the movement arm, the foot engagement member having an engagement surface configured to receive a portion of the sole of the foot of the exerciser and being adjustable in position relative to the movement arm; and a resistance-imparting unit. The movement arm is movable by the exerciser between a flexed position, in which the sole of the foot of the exerciser engages the engagement surface of the foot engagement member such that the foot is generally perpendicular to the shin of exerciser, and an extended position, in which the foot points away from the shin as the sole of the foot of the exerciser remains engaged with the engagement surface.

DETAILED DESCRIPTION OF EMBODIMENTS OF THE INVENTION

Figure 1:
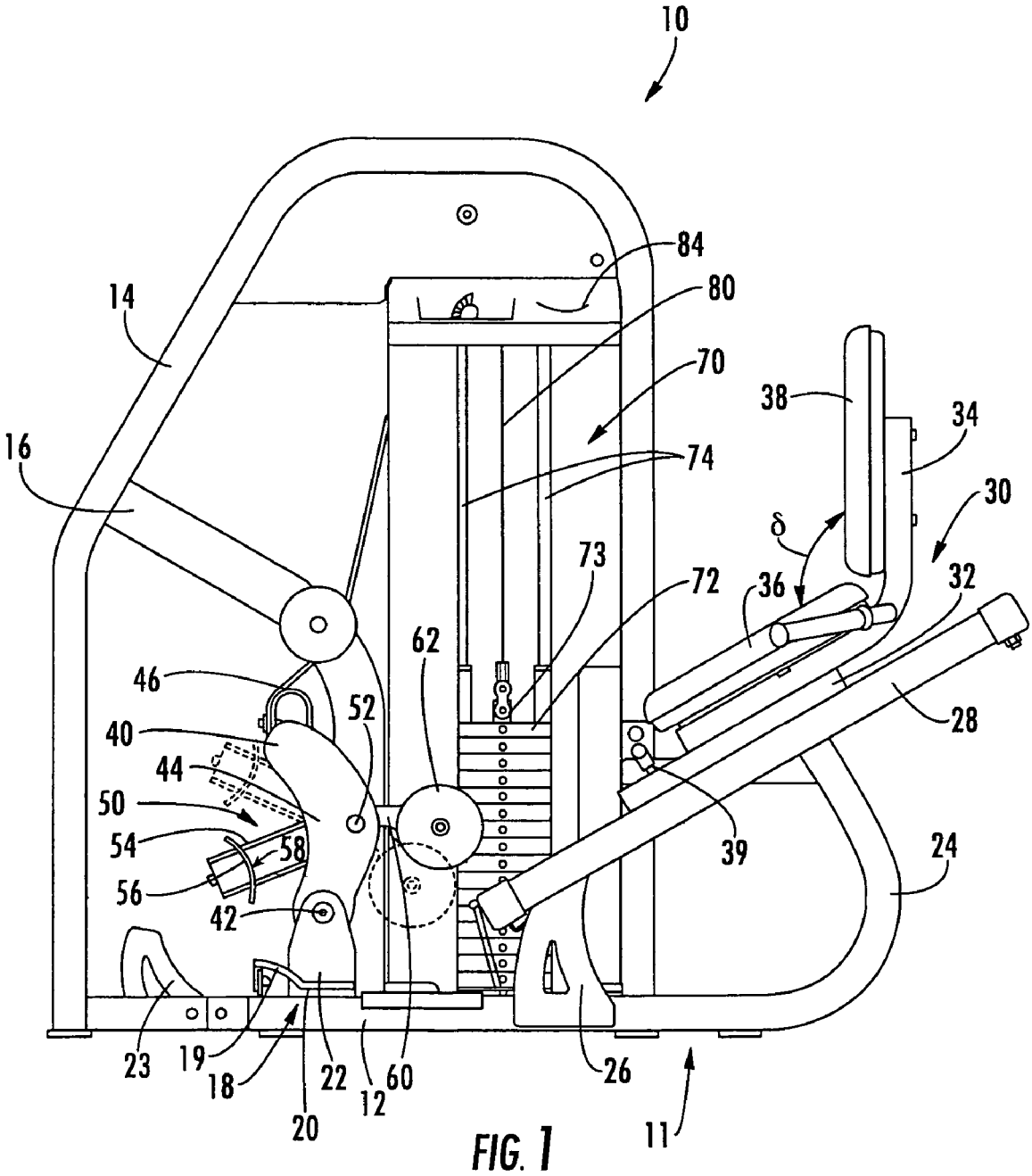
FIG. 1 is a side view of an embodiment of a seated calf extension exercise machine of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity. In addition, the sequence of operations (or steps) is not limited to the order presented in the claims unless specifically indicated otherwise. Where used, the terms "attached", "connected", "interconnected", "contacting", "coupled", "mounted" and the like can mean either direct or indirect attachment or contact between elements, unless stated otherwise.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

Referring now to the figures, a seated calf exercise machine, designated broadly at 10, is illustrated in FIG. 1. In describing the machine 10, it will be assumed for the purposes of description that the terms "front", "forward", and derivatives thereof refer to the horizontal direction a seated exerciser faces (i.e., to the left as shown in FIG. 1) when performing the exercise movement. The term "rear" and derivatives thereof refer to the horizontal direction that is opposite the "forward" direction (i.e., to the right as shown in FIG. 1). Together, the "forward" and "rear" directions comprise the "longitudinal" dimension of the machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

Referring again to FIG. 1, the machine includes a frame 11 that serves as a foundation for other components of the machine 10. The frame 11 includes a generally horizontal base 12 that rests on an underlying surface. An arch 14 is mounted to forward and rearward portions of the base 12 and extends upwardly therefrom. A brace 16 extends between a forward leg of the arch 14 and a central portion of the base 12. A movement arm bracket 22 is mounted to the base adjacent the brace 16 and projects upwardly. An arcuate seat support 24 is mounted to the rearward end of the base 12 and extends rearwardly and upwardly therefrom. A seat rail 28 is mounted atop the seat support 24 and a seat bracket 26 that is mounted to the base 12 and slopes upwardly as it extends rearwardly from the seat bracket 26.

Those skilled in this art will recognize that the frame 11 illustrated herein is exemplary and can take many configurations that would be suitable for use with the present invention. The frame 11 provides a strong, rigid foundation to which other components can be attached at desired locations, and other frame forms able to serve this purpose may also be acceptable for use with this invention.

Referring still to FIG. 1, also mounted to the frame 11 are a heel pad 18 and a stop member 23. The heel pad 18 includes a rear flat surface 20 and a forward convex surface 19. The heel pad 18 is mounted to the base 12 such that the flat surface 20 is directly below the movement arm bracket 22, with the convex surface 19 being positioned predominantly forward of the movement arm bracket 22. The stop member 23 is mounted to the base 12 forwardly of the heel pad 18.

Referring again to FIG. 1, a seat assembly 30 is mounted on the seat rail 28. The seat assembly includes a seat carriage 32 that is slidably and adjustably mounted on the seat rail 28 for movement parallel to the seat rail 28. An angled seat frame 34 is mounted on the seat carriage 32. A seat 36 is mounted to the forward portion of the seat frame 34, and a backrest 38 is mounted to a rear portion of the seat frame 34. Typically, the obtuse angle δ defined by the seat 36 and the backrest 38 is between about 120 and 135 degrees, particularly when the angle of the seat carriage 32 to the underlying surface is about 30 degrees. The position of the carriage 32 (and, in turn, the seat 36 and backrest 38) can be adjusted through the use of an adjustment pin 39, which is inserted through an aperture in the carriage and into one of multiple apertures in the seat rail 28.

Referring once again to FIG. 1, an angled movement arm 40 is pivotally interconnected with the movement arm bracket 22 at a pivot 42. A trailing link 50 is pivotally interconnected with the movement arm 40 at a pivot 52. These components will be described in greater detail below as they reside in the "flexed" position illustrated in FIG. 1; their movements during operation of the machine 10 will be described subsequently.

The movement arm 40 extends upwardly and slightly rearwardly from the pivot 42 to a vertex 44, then upwardly and slightly forwardly therefrom. A belt attachment tab 46 is fixed to the free end of the movement arm 40. In the flexed position, the belt attachment tab 46 is slightly forward of the pivot 42.

As noted above, the trailing link 50 is pivotally interconnected to the movement arm 40 at a pivot 52; this pivot is located approximately at the vertex 44 of the movement arm 40. The trailing link 50 includes a forward member 54 that extends forwardly from the pivot 52. A foot engagement member 56 is fixed to and extends transversely from a front end portion of the forward member 54. The foot engagement member 56 has a convex engagement surface 58 that faces the pivot 52. The trailing link 50 also includes an optional counterweight 62 mounted on a stem 60 that extends generally opposite the forward member 54.

Those skilled in this art will appreciate that both the movement arm 40 and the trailing link 50 may take other forms and still be suitable for use with the present invention. For example, either of these links may take a straight configuration, or be angled differently, or take a tripartite structure. As another example, the counterweight 62 may be omitted. Also, the foot engagement member may have a flat, rather than a convex, engagement surface, and/or the engagement surface may be discontinuous so that each of the user's feet has a separate engagement surface. Other variations that enable the foot engagement member 56 to be adjusted relative to the movement arm 40 will be recognized by those skilled in this art as suitable for use with the present invention.

Referring again to FIG. 1, a weight stack 70 includes a set of weights 72 arranged in a vertical stack just above the base 12. A lifting rod 73 extends vertically through apertures in the weights 72 and is configured to receive a pin inserted between individual weights 72 that enables the user to select the number of weights to be used in the exercise. The weight stack 70 also includes guide rods 74 that extend vertically through the weights 72 to guide the weights 72 along a vertical path during exercise. Weight stacks of this variety are well known to those skilled in this art and need not be described in detailed herein. In addition, the machine 10 may include a set of auxiliary weights (not shown) that slide along a vertical guide rod and that can be temporarily connected with the selected weights to provide incremental weight during exercise. Again, auxiliary weight systems of this type are well known to those skilled in this art and need not be described in detail herein. An exemplary machine having such a weight stack is a seated calf machine available from Nautilus HPS, Inc. (Independence, Va.) under the trade name 2St Seated Calf.

Those skilled in this art will recognize that, although a weight stack is the preferred structure for providing resistance to the exerciser, other resistance-imparting structures, such as friction-imparting devices, variable viscosity devices, air drag-based resistance devices, and the like, may also be employed with a seated calf extension machine of the present invention. Exemplary resistance devices include those illustrated in U.S. Pat. Nos. 5,810,096, 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

The weight stack 70 is coupled with the movement arm 40 via a belt 80 that is attached to the belt attachment tab 46. The belt 80 extends upwardly from the lifting rod 73 to engage a pulley (not shown) mounted to the center of a pulley mounting platform 84. The belt 80 then travels forwardly to another pulley (also not shown), then downwardly to engage the underside of a diverting pulley 82 that is mounted on the brace 16. The belt 80 then travels downwardly and forwardly to attach to the belt engagement tab 46.

Those skilled in this art will recognize that other components, such as chains, cables and other flexible members, can be employed to interconnect the weight stack 70 or another resistance-imparting unit with the movement arm 40. Also, arrangement of pulleys that define the path of the belt 80 may be varied, with the understanding that any variation should arrange the pulleys such that tension in the belt 80 caused by exercise meets resistance (in the case of a weight stack, tension in the cable causes the selected weights to rise). Further, some or all of the pulleys themselves may be replaced with other components, (cams, diverting brackets, or the like) that can engage and redirect the belt 80 as desired.

To operate the machine 10, a user first selects a desired amount of resistance and inserts the pin into the lifting rod 73 between two weights 72 that correspond to that resistance. The user also adjusts the position of the seat assembly 30 by inserting the pin 39 into an appropriate aperture in the seat rail 28. The seat assembly should be positioned so that, when the user is seated on the seat 36 with his back against the backrest 38, his heels rest on the heel pad 18 against the convex surface 19. With the user's feet in place, the position of the trailing link 50 is then adjusted.

Figure 2A:
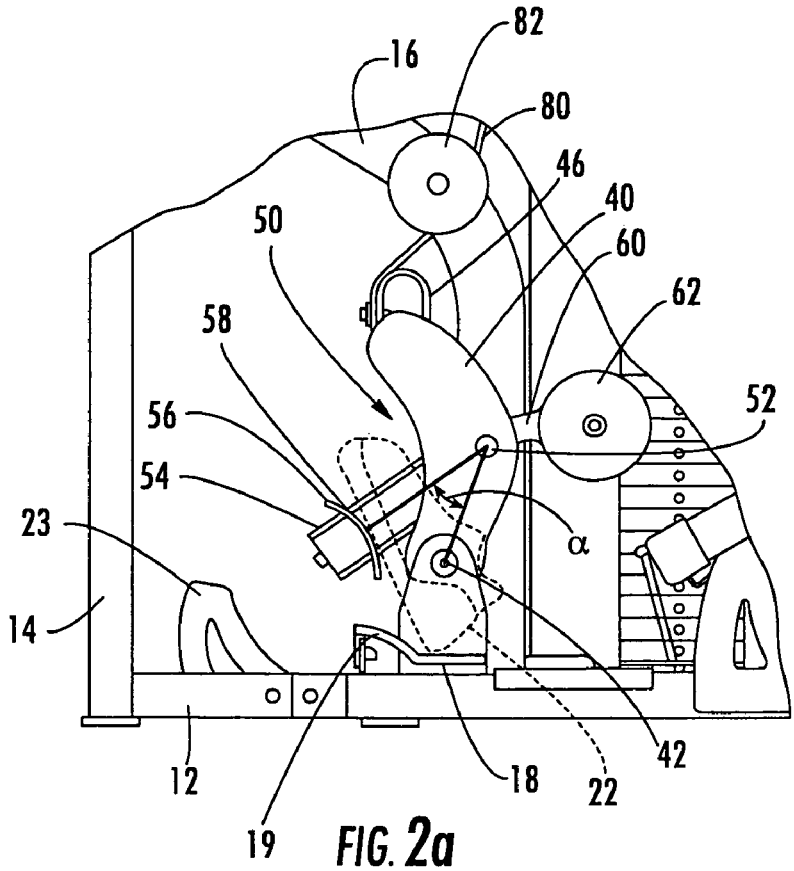
FIG. 2*a* is a side view of the seated calf extension exercise machine of FIG. 1, with the machine in the flexed position and the foot engagement member adjusted for a user with a small foot.
Figure 3A:
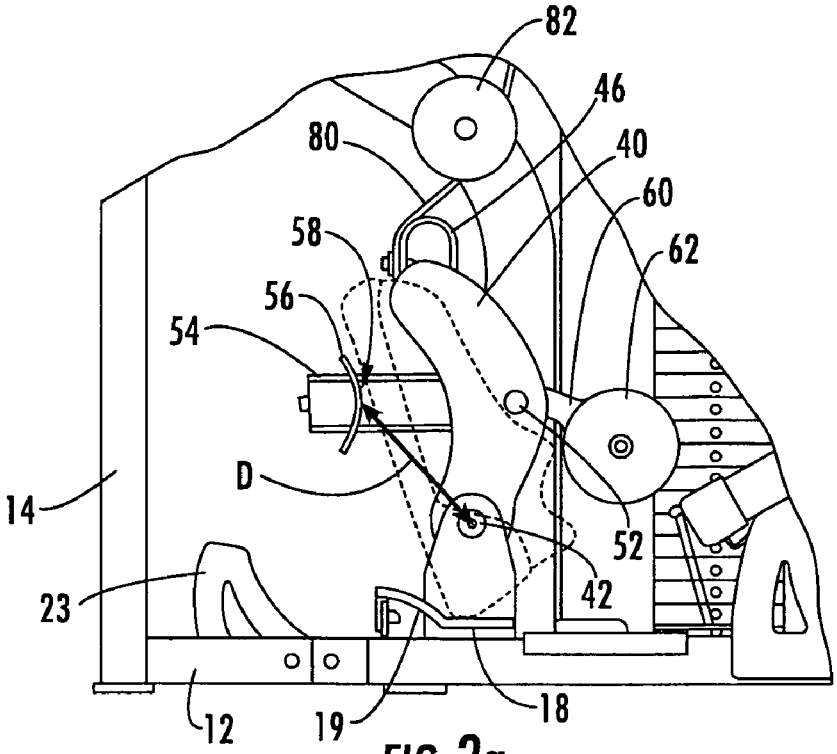
FIG. 3*a* is a side view of the seated calf extension exercise machine of FIG. 1, with the machine in the flexed position and the foot engagement member adjusted for a user with a large foot.

The user pivots the trailing link about the pivot 52 (see an exemplary alternative position in phantom line in FIG. 1) until the engagement surface 58 of the foot engagement member 56 is located beneath the balls of the user's feet as the user's feet are in a flexed position that is generally perpendicular to the user's shins (see FIGS. 2*a* and 3*a*). As can be seen in FIGS. 2*a* and 3*a*, pivoting of the trailing link 50 enables users with both smaller feet FIG. 2*a*) and bigger feet (FIG. 3*a*) to position their feet properly on the foot engagement member 56. In this position, the movement arm 40 is generally vertically disposed over the pivot 42, and the pivot 52 between the movement arm 40 and the trailing link 50 is positioned slightly rearward of the pivot 42.

Figure 2B:
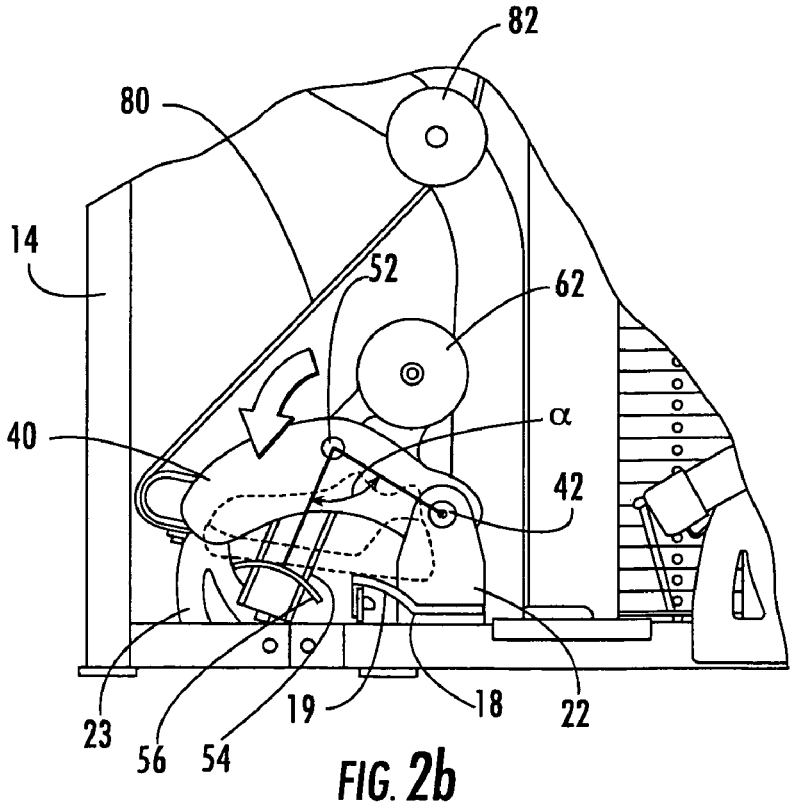
FIG. 2*b* is a side view of the seated calf extension exercise machine of FIG. 1 in use as in FIG. 2*a*, with the machine in the extended position and the foot engagement member adjusted for a user with a small foot.
Figure 3B:
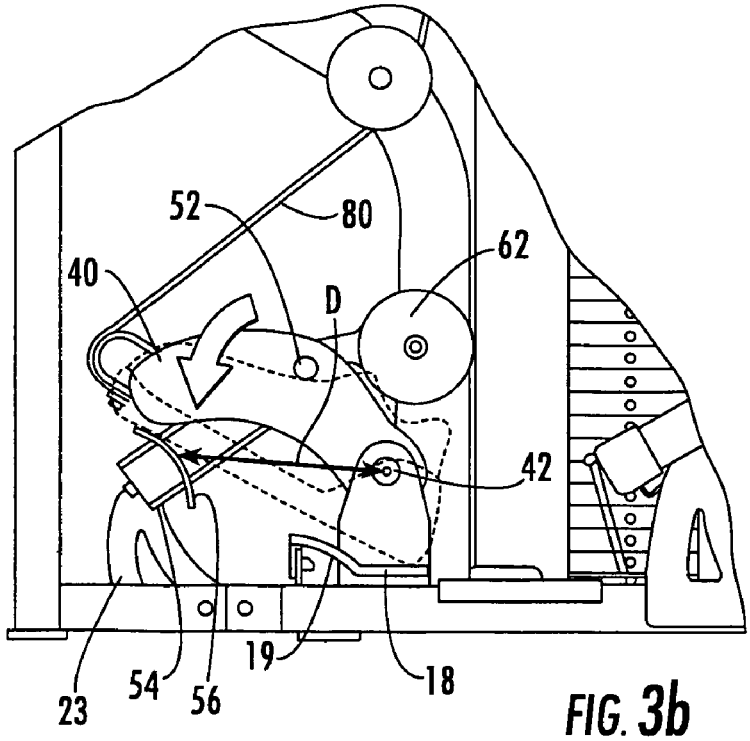
FIG. 3*b* is a side view of the seated calf extension exercise machine of FIG. 1 in use as in FIG. 3*a*, with the machine in the extended position and the foot engagement member adjusted for a user with a large foot.

Once in the flexed position, the user can then perform the exercise movement, which involves contracting the calf muscles to point the toes away from the shin, thereby straightening the leg at the ankle (see FIGS. 2*b* and 3*b*). In this motion, the balls of the user's feet press against the engagement surface 58, which draws the trailing link 50 forward. The trailing link 50 drives the movement arm 40 forward about the pivot 42 (counterclockwise from the vantage point of FIGS. 2*a*-3*b*). This movement is resisted by the selected weights 72, which are interconnected with the belt attachment tab 46 of the movement arm 40 through the belt 80. The extension of the user's feet ceases when a projection (not shown) from the forward member 54 that extends transversely opposite the foot engagement member 56 strikes the stop member 23.

Notably, as the user moves the foot engagement member 56 from the flexed position to the extended position, the trailing link 50 pivots relative to the movement arm 40. As is shown by comparing FIGS. 2*a* and 3*a*, the forward end of the trailing link 50 and the lower end of the movement arm 40 tend to separate as the trailing link 50 travels toward the extended position. This can be described in different ways. One way of describing this motion is that the engagement surface 58 tends to separate from the pivot 42 as the trailing link 50 moves to the extended position (i.e., the distance D between the pivot 42 and the engagement surface 58 increases as the trailing link 50 moves to the extended position—see FIGS. 2*a* and 2*b*). Another way is that an angle $\alpha$ defined between the pivot 42, the pivot 52, and a point on the engagement surface 58 is greater in the extended position than in the flexed position (see FIGS. 2*a* and 2*b*). Typically, the angle $\alpha$ increases by between about 70 and 130 degrees in moving from the flexed to the extended position.

The above-described relative movement between the trailing link 50 and the movement arm 40 can have multiple advantages. First, the engagement surface 58 can be adjusted to accommodate different sizes of feet. Second, engagement between the ball of the foot of the user and the engagement surface 58 can be improved. As the user extends his foot, the heel tends to roll forward on the convex surface 19 of the heel pad 18. The ability of the trailing link 50 to pivot relative to the movement arm 40 can enable the ball of the foot to roll on and remain in contact with the engagement surface 58 (aided to a certain extent by the convex profile of the engagement surface 58) as the heel rolls forward. As a result, there can be reduced tendency for the user to "stand up" during the exercise stroke.

Figure 4:
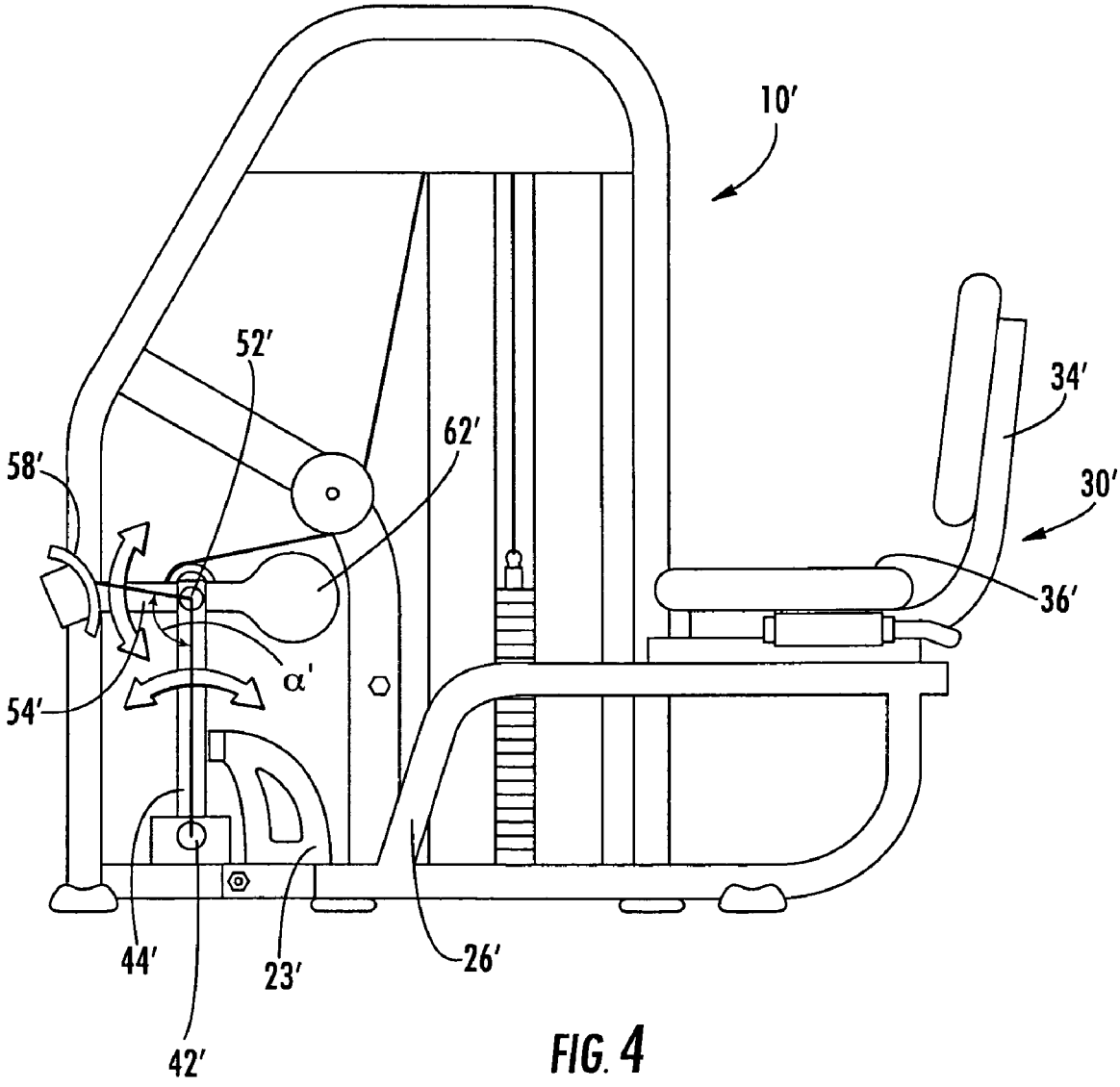
FIG. 4 is a side view of an alternative embodiment of a seated calf extension exercise machine of the present invention.

An alternative embodiment of the present invention, designated broadly at 10', is illustrated in FIG. 4. In this embodiment, the machine 10' includes a frame 11' that is similar to the frame 11 of the embodiment of FIGS. 1-3 with the exception that the seat bracket 26 is replaced with an upright 26' that supports the forward portion of the seat assembly 30'. The upright 26' is sized such that the seat 36' of the seat assembly 30' is substantially horizontal. Also, the seat frame 34' is bent to a lesser angle. In this embodiment, there is no heel pad. Instead, the movement arm 44' rises upwardly from a pivot 42' with the frame 11' to a pivot 52' with the trailing link 50'. On one end the trailing link 50' has a counterweight 62', and on the other end the trailing link 50' supports a foot engagement surface 56' with an engagement surface 58'.

Operation of the machine 10' proceeds in much the same manner as that of the machine 10, with the exception that the heel of the exercise is unsupported. After setting the resistance, the exerciser positions the engagement surface 58' to engage the ball of the foot in the flexed position as the movement arm 44' rests against a stop member 23', then extends his foot as this movement is resisted by the weights. The movement arm 44' pivots about the pivot 42', and the trailing link 50' pivots about the pivot 52' relative to the movement arm 44'. The angle $\alpha'$ increases as the exerciser moves from the flexed position to the extended position. This movement can reduce the tendency of the exerciser to "stand up" during the exercise stroke.

Those skilled in this art will appreciate that, although the machines 10, 10' are illustrated as "stand-alone" machines, either can be incorporated as a station into a multi-station exercise machine, such as that available from Nautilus HPS, Inc. under the trade name PERSONAL CIRCUIT. In such a machine, the seat calf extension station may have its own weight stack or, more typically, may share its weight stack with one or more stations. The ordinarily skilled artisan will understand the modifications to the seated calf extension machine of the present invention that may be needed in order that the seated calf station be utilized within a multi-station exercise machine.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An exercise machine for exercising the calf muscles of a seated exerciser, comprising:

a frame configured to rest on an underlying surface;

a seat assembly mounted on the frame on which the exerciser sits;

a movement arm pivotally interconnected with the frame forward of the seat assembly;

a trailing link pivotally attached to the movement arm;

a foot engagement member attached to the trailing link, the foot engagement member having an engagement surface configured to receive a portion of the sole of the foot of the exerciser;

wherein the movement arm is movable by the exerciser between a flexed position, in which the sole of the foot of the exerciser engages the engagement surface of the foot engagement member such that the foot is generally perpendicular to the shin of exerciser, and an extended position, in which the foot points away from the shin as the sole of the foot of the exerciser remains engaged with the engagement surface of the foot engagement member; and a resistance-imparting unit interconnected with the movement arm that provides resistance to the movement of the movement arm from the flexed position to the extended position;

further comprising a heel pad mounted on the frame forwardly of the seat assembly and configured to receive the heel of the exerciser, wherein the heel of the exerciser remains engaged with the heel pad in the flexed and extended positions.

2. The exercise machine defined in claim 1, wherein the foot engagement member is fixed to the trailing link.

3. The exercise machine defined in claim 1, wherein the trailing link includes a counterweight generally opposite the foot engagement member.

4. The exercise machine defined in claim 1, wherein the resistance-imparting unit comprises a weight stack.

5. The exercise machine defined in claim 1, wherein the resistance-imparting unit comprises a flexible member attached to the movement arm.

6. The exercise machine defined in claim 1, wherein the seat assembly and the heel pad are mounted on the frame so that, in the flexed position, the exerciser's legs are substantially straight at the knee.

7. The exercise machine defined in claim 1, wherein the heel pad includes a convex surface at a forward portion thereof.

8. The exercise machine defined in claim 1, wherein the engagement surface of the foot engagement member includes a portion that is convex in cross-section.

9. The exercise machine defined in claim 1, wherein the heel pad, the engagement surface, the trailing link and the movement arm are configured and arranged such that an angle defined between (a) a first pivot between the movement arm and the frame, (b) a second pivot between the trailing link and the movement arm, and (c) a point on the engagement surface is greater in the extended position than in the flexed position.

10. The exercise machine defined in claim 1, wherein the seat assembly includes a seat and a backrest, and wherein the seat defines an obtuse angle with the backrest.

11. The exercise machine defined in claim 10, wherein the seat assembly is adjustable relative to the frame.

12. The exercise machine defined in claim 1, wherein the frame further includes a stop member that ceases motion of the movement arm in the extended position.

13. An exercise machine for exercising the calf muscles of a seated exerciser, comprising:

a frame configured to rest on an underlying surface;

a seat assembly mounted on the frame on which the exerciser sits;

a movement arm pivotally interconnected with the frame forwardly of the seat assembly at a first pivot;

a foot engagement member connected with the movement arm, the foot engagement member having an engagement surface configured to receive a portion of the sole of the foot of the exerciser;

wherein the movement arm is movable by the exerciser between a flexed position, in which the sole of the foot of the exerciser engages the engagement surface of the foot engagement member such that the foot is generally perpendicular to the shin of exerciser and the engagement surface is a first distance from the first pivot, and an extended position, in which the foot points away from the shin as the sole of the foot of the exerciser remains engaged with the engagement surface, the engagement surface being positioned a second distance from the first pivot that is greater than the first distance; and a resistance-imparting unit interconnected with the movement arm that provides resistance to the movement of the movement arm from the flexed position to the extended position;

further comprising a heel pad mounted on the frame forwardly of the seat assembly and configured to receive the heel of the exerciser, wherein the heel of the exerciser remains engaged with the heel pad in the flexed and extended positions.

14. The exercise machine defined in claim 13, wherein the foot engagement member is attached with the movement arm via a trailing link that is pivotally interconnected with the movement arm.

15. The exercise machine defined in claim 14, wherein the foot engagement member is fixed to the trailing link.

16. The exercise machine defined in claim 13, wherein the resistance-imparting unit comprises a weight stack.

17. The exercise machine defined in claim 13, wherein the resistance-imparting unit comprises a flexible member attached to the movement arm.

18. The exercise machine defined in claim 13, wherein the seat assembly and the heel pad are mounted on the frame so that, in the flexed position, the exerciser's legs are substantially straight at the knee.

19. The exercise machine defined in claim 13, wherein the heel pad includes a convex surface at a forward portion thereof.

20. The exercise machine defined in claim 13, wherein the engagement surface of the foot engagement member includes a portion that is convex in cross-section.

21. The exercise machine defined in claim 13, wherein the heel pad, the engagement surface, the trailing link and the movement arm are configured and arranged such that an angle defined between (a) the first pivot, (b) a second pivot between the trailing link and the movement arm, and (c) a point on the engagement surface is greater in the extended position than in the flexed position.

22. The exercise machine defined in claim 14, wherein the seat assembly includes a seat and a backrest, and wherein the seat defines an obtuse angle with the backrest.

23. The exercise machine defined in claim 22, wherein the seat assembly is adjustable relative to the frame.

24. The exercise machine defined in claim 14, wherein the frame further includes a stop member that ceases motion of the movement arm in the extended position.

25. An exercise machine for exercising the calf muscles of a seated exerciser, comprising:

a frame configured to rest on an underlying surface;

a seat assembly mounted on the frame on which the exerciser sits;

a movement arm pivotally interconnected with the frame forwardly of the seat assembly;

a foot engagement member connected with the movement arm, the foot engagement member having an engagement surface configured to receive a portion of the sole of the foot of the exerciser, the foot engagement member being adjustable in position relative to the movement arm;

wherein the movement arm is movable by the exerciser between a flexed position, in which the sole of the foot of the exerciser engages the engagement surface of the foot engagement member such that the foot is generally perpendicular to the shin of exerciser, and an extended position, in which the foot points away from the shin as the sole of the foot of the exerciser remains engaged with the engagement surface; and a resistance-imparting unit interconnected with the movement arm that provides resistance to the movement of the movement arm from the flexed position to the extended position;

further comprising a heel pad mounted on the frame forwardly of the seat assembly and configured to receive the heel of the exerciser, wherein the heel of the exerciser remains engaged with the heel pad in the flexed and extended positions.

26. The exercise machine defined in claim 25, wherein the foot engagement member is attached with the movement arm via a trailing link that is pivotally interconnected with the movement arm.

27. The exercise machine defined in claim 26, wherein the foot engagement member is fixed to the trailing link.

28. The exercise machine defined in claim 25, wherein the resistance-imparting unit comprises a weight stack.

29. The exercise machine defined in claim 25, wherein the resistance-imparting unit comprises a flexible member attached to the movement arm.

30. The exercise machine defined in claim 25, wherein the seat assembly and the heel pad are mounted on the frame so that, in the flexed position, the exerciser's legs are substantially straight at the knee.

31. The exercise machine defined in claim 25, wherein the heel pad includes a convex surface at a forward portion thereof.

32. The exercise machine defined in claim 25, wherein the engagement surface of the foot engagement member includes a portion that is convex in cross-section.

33. The exercise machine defined in claim 25, wherein the heel pad, the engagement surface, the trailing link and the movement arm are configured and arranged such that an angle defined between (a) the first pivot, (b) a second pivot between the trailing link and the movement arm, and (c) a point on the engagement surface is greater in the extended position than in the flexed position.

34. The exercise machine defined in claim 26, wherein the seat assembly includes a seat and a backrest, and wherein the seat defines an obtuse angle with the backrest.

35. The exercise machine defined in claim 34, wherein the seat assembly is adjustable relative to the frame.

36. The exercise machine defined in claim 26, wherein the frame further includes a stop member that ceases motion of the movement arm in the extended position.

* * * * *